US007228720B2

(12) United States Patent
Bodnar

(10) Patent No.: US 7,228,720 B2
(45) Date of Patent: Jun. 12, 2007

(54) ROTARY APPARATUS AND METHOD

(76) Inventor: Ernest R. Bodnar, 2 Danrose Crescent, Toronto, Ontario (CA) M3B 3N5

( * ) Notice: Subject to any disclaimer, the term of this patent is extended or adjusted under 35 U.S.C. 154(b) by 379 days.

(21) Appl. No.: 10/187,811

(22) Filed: Jul. 3, 2002

(65) Prior Publication Data

US 2004/0003641 A1 Jan. 8, 2004

(51) Int. Cl.
*B21B 21/00* (2006.01)

(52) U.S. Cl. ..... 72/190; 72/186; 72/195

(58) Field of Classification Search ..... 72/186, 72/190, 195

See application file for complete search history.

(56) References Cited

U.S. PATENT DOCUMENTS 3,512,477 A * 5/1970 Nelson ..... 72/195
4,732,028 A * 3/1988 Bodnar ..... 72/190
RE33,613 E * 6/1991 Bodnar ..... 72/190
5,040,397 A * 8/1991 Bodnar ..... 72/190
5,561,998 A * 10/1996 Bodnar ..... 72/190
5,791,185 A * 8/1998 Bodnar ..... 72/190
6,018,973 A * 2/2000 Surina ..... 72/190

* cited by examiner

*Primary Examiner*—Dmitry Suhol

(57) ABSTRACT

A rotary apparatus having a first rotating die assembly and a second rotating die assembly arranged in juxtaposition with one another on respective first and second sides of a strip work piece movement path, and operable in unison together to perform operations on a work piece passing therebetween, each die assembly having a main rotor mounted for rotation, at least one die support body supported by the main rotor, and being swingable relative to the main rotor, control cams connected the die support body, cam guides engageable by the control cams, and die support body bearings mounted on the main rotor for carrying the die support body. The die support body can be self-adjusting to the linear speed on the work piece, before and after contact. The die can have a movable portion which moves in or out to provide selective operation on the workpiece. The main rotors are connected by a gear drive train with anti-backlash adjustment. The method of operation on a work piece permits formation of a continuous series of spaced apart formations in the workpiece and permits skipping of formations at desired intervals to produce product of specific lengths.

14 Claims, 15 Drawing Sheets

54
56
58
56
58
56
52
54
36
26
60
40

54
58
56
56
58
38
56

54
56
58
56
58
56

15
34
38
54
36
15
26

ROTARY APPARATUS AND METHOD

FIELD OF THE INVENTION

The invention relates to a rotary apparatus for performing rotary operations, such as stamping, forming and the like, on continuously moving strip material, and to a method of rotary operation.

BACKGROUND OF THE INVENTION

Performing operations on continuously moving strip material presents numerous problems. Usually such operations will be in the nature of stamping at spaced intervals, or blanking, or forming of such strip material. These operations conventionally are performed while the work piece material is stationary, using some kind of conventional press with upper and lower blades or dies, which simply close and open on the work piece.

In some cases operations have been performed on a moving strip by so-called "flying dies".

In this type of operation the dies which shear, shape, or form the strip workpiece, are mounted on slides. The dies can slide forward along the path of the moving strip, close, and open, and then slide back again. Such flying dies are well known, and have been shown in patents for many years Rotary forming machines are also shown in more recent patents. In these machines the forming dies are mounted on pairs of upper and lower rotatable support rolls. Machines of this type were usually designed and built to perform specific continuous repetitive functions. They were not readily adaptable to either stamping, or blanking, or forming, depending on the operation desired. In addition such machines experienced other problems, such as in lubrication, wear, timing of operations, and sequencing of operations. One of many major applications for such machines is in the forming of sheet metal studs for use in construction. Opposite edges of such metal studs are conventionally roll formed to provide a channel shaped cross section, the so-called "C-section" stud. In a preferred form, such studs are formed with a series of openings blanked out from a sheet metal work piece. Strips of the work piece extend from edge to edge of the stud, between adjacent openings, and form struts across the stud. Edges of the work piece around the openings and strips, are formed at angles to provide flanges for increased strength. Such studs are more thermally efficient, and are also significantly lighter than conventional C-section studs.

In construction such C-section metal studs are used in place of wooden studs for framing walls. In this type of application the industry requires that the studs be fabricated in exact lengths. These lengths will vary depending on the design of the building.

Usually, in the case of these known rotary machines, the rotary operations were intended to be carried out as part of a complete roll forming line which will also have an uncoiler, in some cases a flattener, and, a series of conventional roll forming die stands, for roll forming edge flanges along the length of the stud. Such machinery was intended to be capable of continuous operation at hundreds of feet per minute.

This has not always been achieved due in part to shortcomings of the rotary forming apparatus which was then in use. In addition, such continuous production lines could not be repeatedly stopped and started again to accommodate the need for precise location of the openings in each stud. This causes a problem in the fabrication of studs for construction uses. The construction industry requires that the C-section studs be free of openings at each end of each stud. This is because such studs are conventionally used to frame walls. In this type of use, the studs extend vertically at spaced intervals. The upper and lower ends of the studs are secured in horizontal metal C-section channels in most case, similar to framing using wooden studs. To achieve this the studs must be free of openings at each end. This is difficult to achieve using any known machinery. It requires that the blanking of the openings and the forming of the edges be carried out in a precisely timed sequence. At each end of each stud work piece there must be a brief, momentary halt in the blanking and forming operations, so as to leave the two ends of each stud free of openings. However the actual movement of the strip work piece cannot stop, since as explained it is part of a larger facility operating on a continuous basis. Timing these spaces between openings, when the strip is moving continuously at high speeds, for example 2–300 feet per minute, or more in some cases, becomes a challenge to any machine operator.

Another consideration is the need to pass services through the studs. For this reason all openings in each stud must align with corresponding openings in adjacent studs.

A further and different factor is that stress requirements for studs may vary from one building, or application, to another. Interior walls or partitions will require a much lower strength stud than exterior, or bearing walls. This may require openings to be spaced further apart, or closer together, along the length of the stud, and may require wider or narrower struts between openings, to provide the specific strength required for the application. Obviously there will also be major changes in the thickness of the strip sheet metal. The entire production line of machines must be adaptable to all these variations, to achieve economical and efficient production.

A more obvious factor is that such rotary machines are costly. In the past it was sometimes necessary to have four rotary machine, arranged one after the other, along the movement path of the work piece, to first of all blank out openings, and then to form the edges of the work piece around the openings.

Four such machines were required in many cases because the shape of the openings in the workpiece was generally triangular, and adjacent openings were oriented in opposite directions and thus alternated along the length of the work piece. This required two sets of blanking dies and two sets of forming dies, and thus involved four rotary machines. In most cases such rotary machines had to be custom designed to suit a particular type of operation, and were not readily adaptable to be converted from one type of operation to another, depending on the needs of the customers of the fabricator.

In many cases a fifth rotary machine was required to cut the work piece to length. Such costs could be justified where production volumes were large. However in many cases where production could not be maintained on a continuous basis, or where orders required the production of a variety of different studs of different gauge and having different lengths and different specifications, such an investment could not be made. Clearly if rotary machines could be made, which could be adapted, by the owner, by relatively easy, in-plant adjustments, so that the machines could perform, at different times or in different locations, various different operations, such as stamping, blanking or forming, of strip material, and were readily adjustable to variations in specifications from one order to the next, then rotary machines could achieve a wider distribution.

BRIEF SUMMARY OF THE INVENTION

With a view to solving at least some of the foregoing problems the invention provides a rotary apparatus having a first rotating die assembly and a second rotating die assembly arranged in juxtaposition with one another on respective first and second sides of a strip work piece movement path, and operable in unison together to perform operations on said work piece passing therebetween, each said die assembly comprising, a main rotor mounted for rotation, at least one die support body supported by said main rotor, and being swingable relative to said main rotor, control cams connected to said at least one die support body, cam guides engageable by said control cams, die support body bearings mounted on said main rotor for carrying said die support body, and, moveable mountings for said die support body bearings permitting movement of said die support body bearings relative to said main rotor.

The invention further provides a rotary apparatus wherein the moveable mountings are spring biased in a retrograde position relative to the direction of rotation of said main die rotors, and are moveable against such biasing to permit temporary advancing movement of said bearings.

The invention further provides a rotary apparatus wherein the bearings have bearing bodies having a predetermined bearing body width dimension, and including bearing recesses formed in said main rotors for receiving said bearing bodies, said bearing recesses defining a bearing recess width greater than said bearing body width, whereby said bearing bodies are moveable within said bearing recesses.

The invention further provides a rotary apparatus including springs located in said bearing recesses and engaging respective said bearing bodies, and biasing said bearing bodies in a retrograde direction.

The invention further provides a rotary apparatus including a moveable die mounted on a said die support body shaft, said die being moveable radially outwardly and inwardly relative to the rotational axis of the die support shaft, between enabled and disabled positions.

The invention further provides a rotary apparatus and including a die movement control operable to cause said moveable die to move as aforesaid.

The invention further provides a rotary apparatus wherein the die movement control includes a control rod moveable relative to the moveable die, and a rod movement device for moving the rod as the main rotator rotates.

The invention further provides a rotary apparatus having a rod movement device control operable to activate and deactivate said rod movement device whereby to selectively move said moveable die between enabled and disabled positions for selective timing of an operation on said work piece.

The invention further provides a rotary apparatus a plurality of said die support bodies on said main rotor and dies carried by said die support bodies whereby to perform a plurality of said operations on said work piece for each revolution of said main rotor.

The invention further provides a rotary apparatus wherein each pair of said main rotors is operated by an individual electric motor, and having on/off controls and speed controls for said electric motor, whereby each said pair of main rotors may be operated, or stopped, at timings and speeds varying from any adjacent apparatus performing operations on said work piece.

The invention also provides a method of performing rotary operations on a moving work piece by rotating a pair of main rotors on opposite sides of said work piece, said main rotors carrying moveable die support bodies swingable relative to said main rotors, said die support bodies in turn carrying respective dies for performing operations on said work piece, swinging said die support bodies into orientations parallel to but spaced from said work piece, closing and opening said die support bodies on said work piece while remaining parallel to said work piece controlling swinging of said die support bodies by control cams, moving at least one moveable die relative to its die support body between operative and inoperative positions to procure selective operation on said work piece on some revolutions of said main rotors and to prevent operation on said work piece on another revolution of said main rotors.

The various features of novelty which characterize the invention are pointed out with more particularity in the claims annexed to and forming a part of this disclosure. For a better understanding of the invention, its operating advantages and specific objects attained by its use, reference should be made to the accompanying drawings and descriptive matter in which there are illustrated and described preferred embodiments of the invention.

IN THE DRAWINGS

DESCRIPTION OF A SPECIFIC EMBODIMENT

Figure 1:
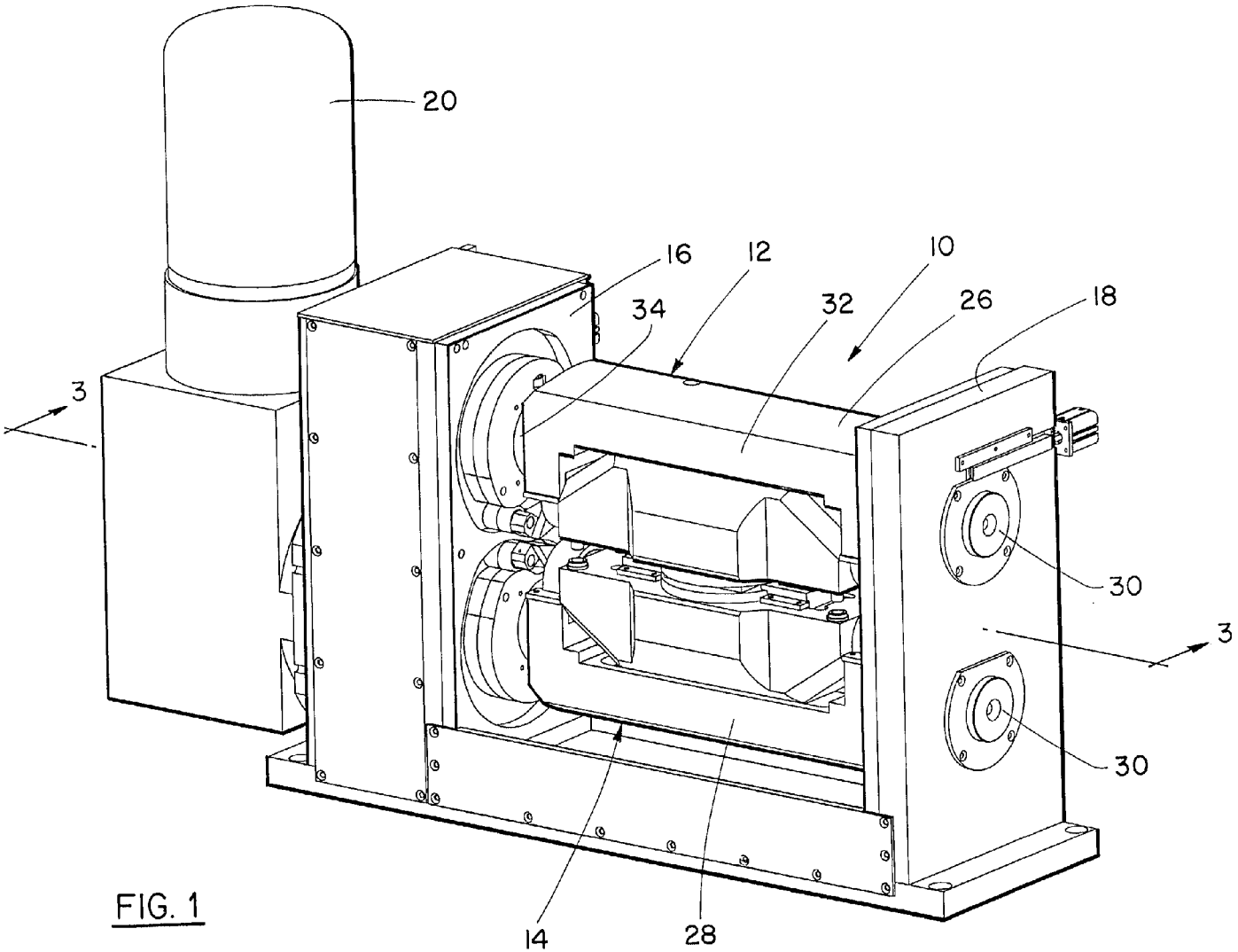
FIG. 1 is a perspective illustration of a rotary apparatus illustrating the invention, and showing in this embodiment an apparatus for punching and forming a work piece, the apparatus having first and second die assemblies, with each said die assembly having only one die support shaft, and only one die carried by said die support shaft.

Referring first of all to FIG. 1 it will be understood that this shows a rotary apparatus (10) which illustrates an embodiment of the invention. In this case there are illustrated two rotary assemblies, namely an upper rotary assembly (12) and a lower rotary assembly (14). In this embodiment as illustrated there is only one die on each rotary assembly. The strip work piece (w) passes between the upper and lower rotary assemblies. Thus as the two rotary assemblies rotate there will be a single operation performed on a strip material work piece each time the rotary assemblies make a complete rotation. However the invention is not restricted to single dies on each assembly As will be shown below there may be cases where it is preferred to provide two dies on each assembly. In other cases it may be preferred to provide more than two dies per assembly, four dies being typical in many cases.

Typical Product

Figure 2:
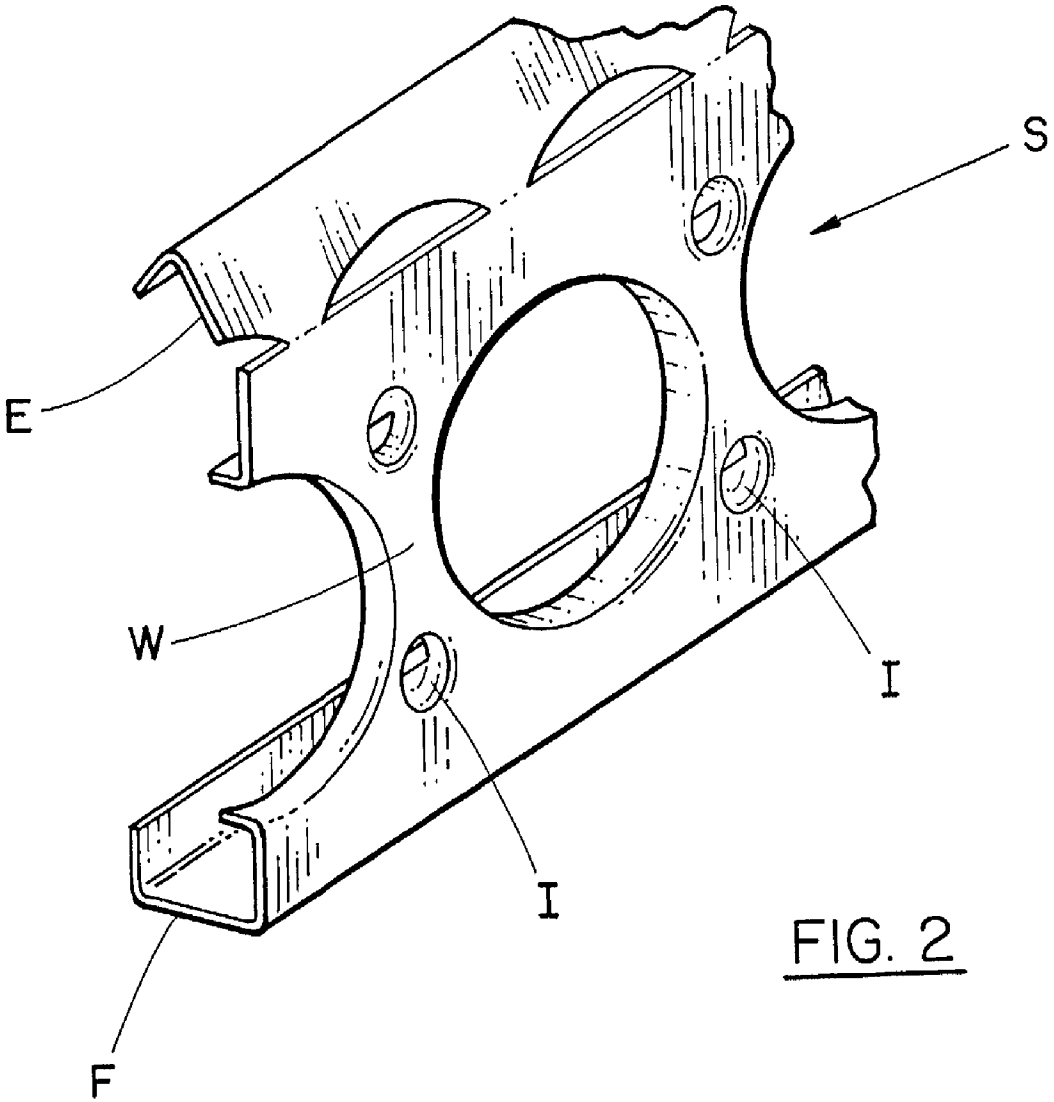
FIG. 2 is a perspective of a typical product, in this case a steel stud for reinforced thin wall concrete panel construction.

A typical product which is merely one of a wide variety of products which may be produced on the rotary apparatus, is shown in FIG. 2. This shows a construction stud S, such as may be used in forming reinforced concrete panels, (not shown) Such a stud may be used in the formation of a thin shell concrete panel which is reinforced on one side by a frame of such studs.

Such studs have a web W and two right angle flanges F. Along the web there are a series of spaced apart openings O. Between the openings and around such openings edges E are formed a 90 degrees for added strength. Indentations I are also formed at spaced intervals for greater strength.

While the web and flanges may be formed on conventional roll forming machinery, the openings, edges and indentations are formed using rotary apparatus of the type described below.

Thus FIG. 1 shows a rotary apparatus (10) having a first, or upper rotary assembly (12) and a second or lower rotary assembly (14). Reference to upper and lower is merely for convenience, and is without limitation.

Upper Rotary Assembly

For the sake of simplicity, the following description is shown, and referred to in relation to the upper rotary assembly (12). Like parts of the lower rotary assembly (14) have like references numbers.

Each rotary assembly is mounted between respective mounting plates (16) and (18). A drive motor (20) is mounted adjacent one of plates (16) or (18) and drives one of the rotary assemblies. A drive gear (22) on the motor shaft and a driven gear (24) drive the other assembly. Thus when the motor operates, both rotary assemblies (12) and (14) will rotate in unison but in opposite directions, one clockwise and the other anti-clockwise. The direction of rotation of both rotary assemblies is in the same direction as the movement of the moving strip work piece (w).

Respective upper and lower rotary assemblies (12) and (14) comprise a respective upper main rotor (26) and lower main rotor (28). The main rotors are carried between main bearings (30) located in the mounting plates (16) and (18). Each main rotor comprises a solid median portion (32) and two stub shafts (34), (34) one at each end of the median portion (32). Stub shafts (34) rotate in main bearings (30).

Figure 3:
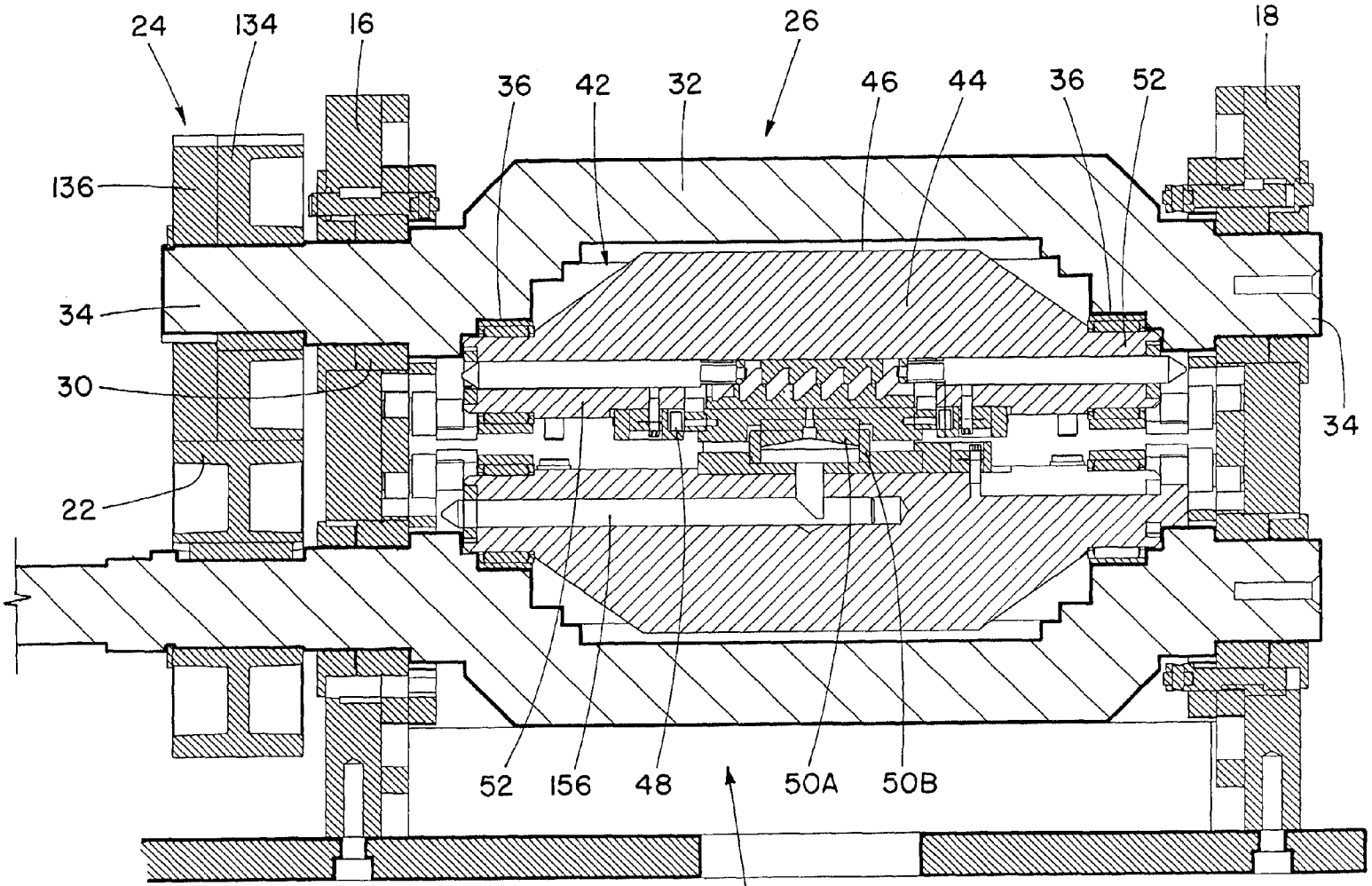
FIG. 3 is a section along line 3—3 of FIG. 1 showing the dies in the enabled position.
Figure 4:
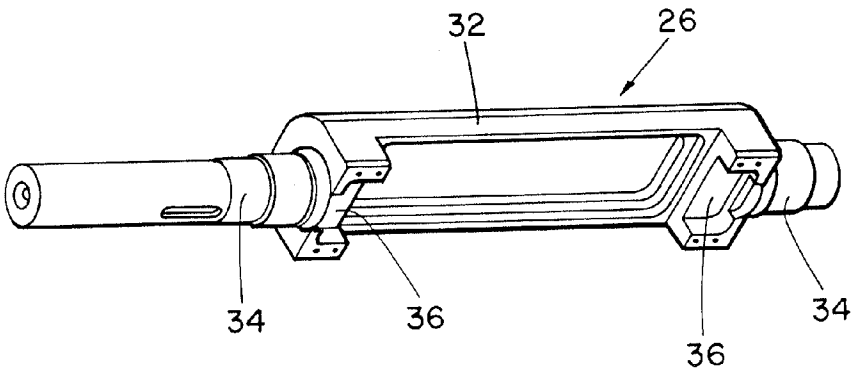
FIG. 4 is a perspective illustration of a die support shaft, in isolation.

Median portion (32) is of generally arch shape in elevation (FIG. 3). At each end of median portion (32) there are respective a die bearing body recesses (36). Die bearing body recesses (36) are of generally three sided rectangular shape, and are formed on the inward concave side of median portion (32). In one side of each die bearing body recess (36) there are formed spring recesses (38) for reception of springs (40) to be described below.

Die Support Body

Swingably mounted in each main rotor (26) or (28) there is, in this embodiment a single die support body (42). There may be more than one die support body on each main rotor as will be described below. Die support body (42) has a central die mounting block (44), which is convex on convex side (46) and generally flat on the other side to provide a die mounting plate (48). A die (50) is shown fastened to die support body (42) on the plate (48). Plate (48) may be recessed if desired and will have suitable bolt recesses formed therein for reception of bolts securing the die thereon. In this way the dies are readily interchangeable with a minimum of down time. The die (50) is merely representative of a typical die which may be used for blanking, forming or stamping operations in the work piece (w). There will be a complementary die (50) in the other of the main rotors. As is well known such pairs of dies (50), or die sets, will usually be male and female dies, one piercing the work piece and the other receiving the slug of sheet metal removed, and discarding it, with suitable slug ejection mechanism. Such a die set may in fact perform two operations almost simultaneously. Thus the dies will first blank out an opening and remove a slug, and will then form the edges of the work piece around the opening. This is advantageous where studs are being manufactured, so as to form openings and flanged struts between the openings, in a single die operation, for greater strength.

For the sake of simplicity both the male and the female die will be referenced as (50). However as will be seen below the male die (50A) will preferably be moveable so as to enable and disable it for selective operations. The female die (50B) will not be moveable, in many cases, since movement is not required, but will have a slug ejector operation which will be performed as described below. However the invention can also provide for movement of both dies between enabled and disabled positions, if the design of the dies, or the end product, require it.

Die Speed Matching

At each end of die mounting block (44) there are stub shafts (52). Stub shafts (52) are swingably mounted in bearing bodies (54) FIGS. 12, 13, 14, and 15. Bearing bodies (54) are of generally rectangular profile, having flat sides (56) on three sides thereof. Preferably bearing bodies (54) are formed with three angled surfaces (58) for reasons to be described, although this feature is not of critical importance. Bearing bodies (54) are dimensioned to fit within die bearing body recesses (36) in their main rotor (26). Bearing bodies (54) are sized to provide a clearance (60) along one side, as shown. Springs (40) extending from spring recesses (38) in main rotor (26) will engage one of flat sides (56) of the bearing bodies (54) and force the bearing bodies (54) to the opposite side of their respective die bearing body recess (36). Sideways pressure, in the reverse direction, applied to bearing bodies (54) will compress the springs (40) and cause the bearing bodies (54) to slide across their respective die bearing body recesses (36) thereby closing the clearances (60). In this way a limited degree of movement of bearing bodies (54) relative to their main rotor (26) or (28) is permitted to occur, enabling the die linear speed to match the linear speed of the web, for reasons described below.

Quick Change Die System

In order to hold the dies (50) in position, and to permit quick exchange of dies to change production, for example, the dies (50) are bolted to side edge brackets (62). Side edge brackets (62) FIGS. 16, 17, 18, 19, 20 and 21, are in turn held in place by slide clamps (64) located on either side of the central die position. In upper main rotor (26) two springs (66) are secured to slide clamps (64). Side edge brackets (62) are provide with spring bearing flanges (68). In order to permit inward and outward movement of die (50A) to disable and to enable it, (see Selective Die System below), springs (66) are compression springs and act on spring bearing flanges (68) so as to urge them inwardly into the die support body (42). Since the side edge brackets (62) are bolted to the die (50A) the springs (66) will thus urge the die (50A) into its retracted or disabled position within die mounting block (44), of die support body (42). Such springs would not usually be required for die (50B) in lower main rotor (28), since in the embodiment illustrated, it is not required to move from enabled to disabled positions, in most cases. However, if the die (50B) is also designed to move between enables and disabled positions, it too will be provided with springs (66) in the same way as described above.

In order to permit quick release and replacement of the dies (50), the slide clamps (64) are held in place by cam bolts (70), secured in die mounting block (44).

The slide clamps (64) are provided with recesses (72) to receive the cam bolts (70). By simply rotating the cam bolts (70) by 90 degrees at each side of the dies (50), the cam bolts (70) move the slide clamps (64) apart and thus release the dies (50) so that they can be removed. New dies (50), having side edge brackets (62) secured thereto can then be placed in position, and the cam bolts (70) are rotated back in the reverse direction. The rotation of the cam bolts (70) in one direction to release the dies (50) has the result of sliding the slide clamps (64) apart so that they release dies (50). Rotation of the cam bolts (70) back again in the reverse direction will cause the slide clamps (64) to move towards one another and engage and secure the dies (50), and the new dies (50) are thus secured.

The cam bolts (70) are threaded into die mounting block (44), so that when they are rotated 90 degrees anti-clockwise, they are withdrawn slightly from their threaded recesses in die mounting block (44). When the cam bolts are rotated back, clockwise, they will tighten down in their threaded recesses and thus clamp the dies firmly in position.

Selective Die Enablement System

As explained above it is desirable to be able, selectively, to enable and to disable at least die (50A), in this embodiment. This permits the apparatus to "skip" an operation on the workpiece. This is particularly useful when making construction studs, for example. In this case while it is desirable to form a series of openings along the stud, it is desirable to be able to skip the formation of an opening at each end of each stud. Disabling and enabling of both dies (50) is also within the scope of the invention. For this embodiment die (50A) is movable intermittently during rotation of the main rotors (26) and (28). This enables the high speed production of product, such as for example construction studs, in precise lengths, and in which formations are made along the length of the product but in which the two ends of the product are free of formations.

To achieve this selective operation, at the high line speeds of which the invention is capable of performing, one, or both, of the dies (50) will incorporate a moveable die portion (74).

In this embodiment die (50A) has a moveable die portion (74), which is moveable radially relative to die mounting block (44), between enabled and disabled positions.

The complementary die (50B) in the other main rotor (28), in this embodiment, has no such moveable portion. However the invention also comprises both dies in a pair or die set, having moveable portions, and permits for selective enabling and disabling of both such dies as desired.

For this purpose die mounting block (44) is formed with a control recess (76) rearwardly of the die (50A).

In order to move the moveable portion (74) of the die (50A) push rods (78) extend rearwardly from moveable portion (74), within control recess (76).

Push rods (78) are connected to a cam plate (80).

Cam plate (80) has a plurality of saw tooth cams (82) formed therein. Tooth cams (82) are right angular on one side and are angled as at (84) on the opposite side.

Cooperating with cam plate (80) is a slideable cam drive body (86). Cam drive body (86) is slideable transversely along an axis parallel to the axis of rotation of the die support body (42). Cam drive body (86) is formed with drive teeth (88) similar in shape and complementary to saw tooth cams (82). Teeth (88) ands tooth cams (82) interfit with one another, when driven in one direction, and thus permit the moveable die portion (74) to retract into the disabled position. Springs (66) normally urge the moveable die portion (74) into the retracted or disabled position and provide the force for such retraction. However when cam drive body (86) is driven transversely, in the opposite direction, drive teeth (88) will react against angled surfaces (84) of cam teeth (82) and force the moveable die portion (74) outwardly radially, into the extended or enabled position.

Figure 5:
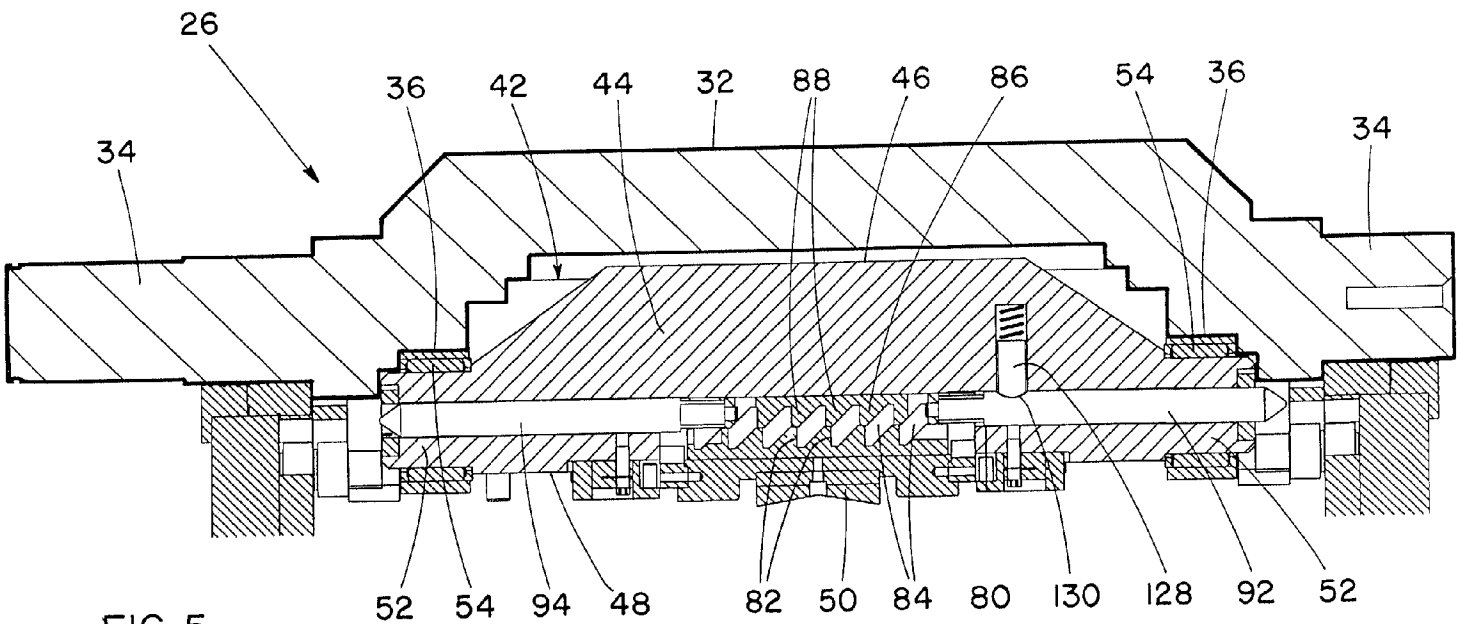
FIG. 5 is a section of a main rotor and die support shaft, with the male die in its extended enabled position.
Figure 6:
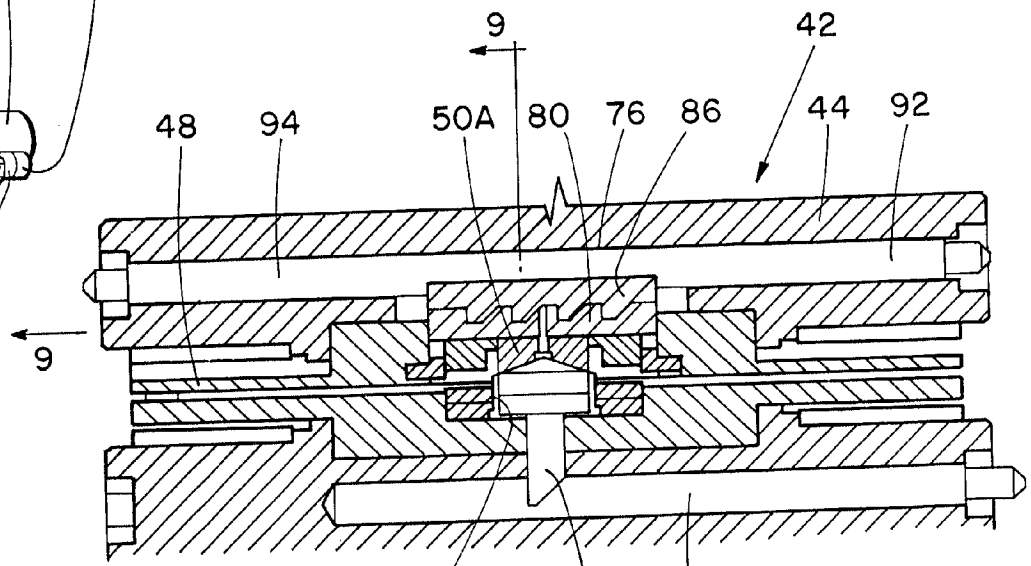
FIG. 6 is a section of a portion of a die shaft, from the opposite side of FIG. 5 showing the male die in its retracted disabled position.
Figure 9:
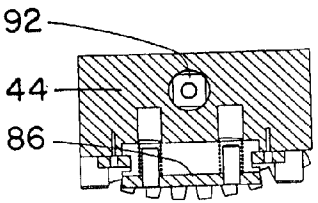
FIG. 9 is a section along line 9—9 of FIG. 6.
Figure 7:
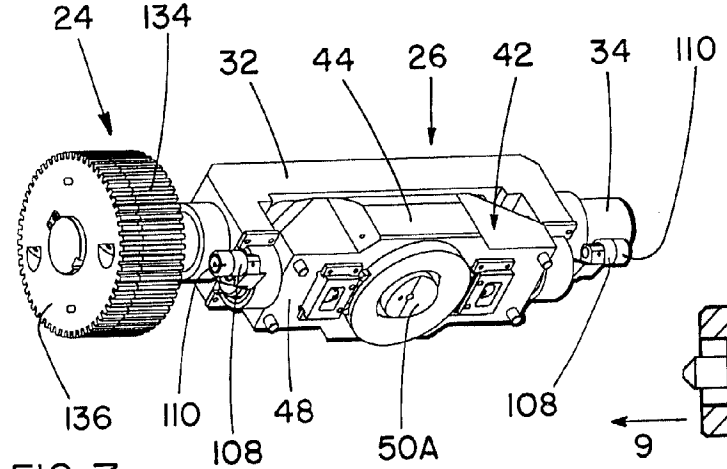
FIG. 7 is a perspective of a main drive shaft and die support body.
Figure 8:
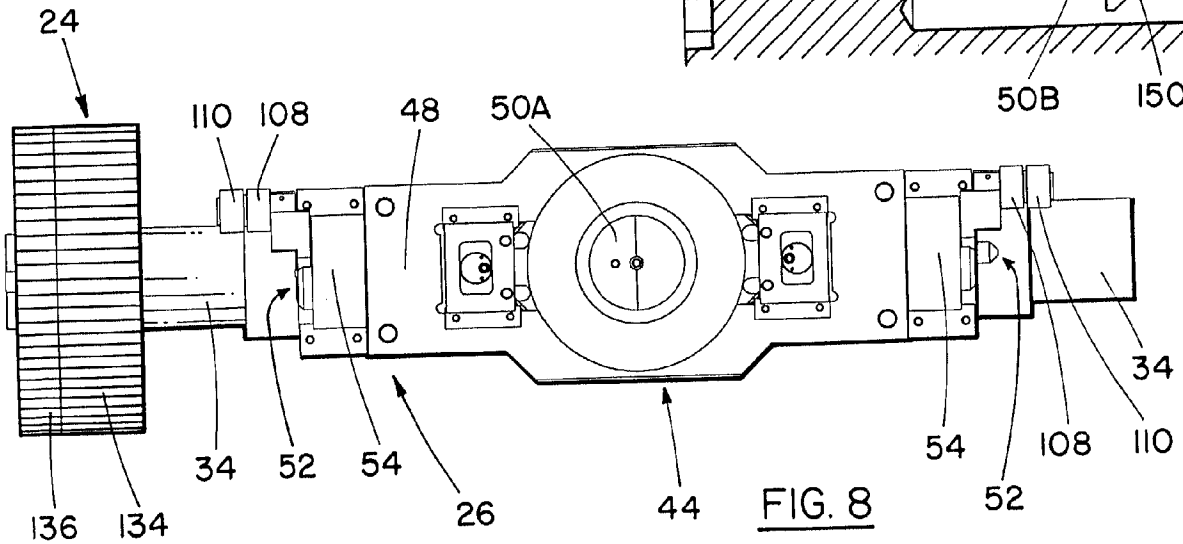
FIG. 8 is a bottom plan view of FIG. 6.

Comparison of FIG. 5 and FIG. 6 will show the two positions. FIG. 5 shows the male die extended into its enabled position and FIG. 6 shows the male die retracted into its disabled position.

Cam drive body (86) is operated by cam control rods (92) and (94). Cam control rods (92) and (94) are connected to opposite sides of cam drive body (86).

Cam control rods (92) and (94) may extend outwardly from one or the other of opposite ends of die mounting block (44) for selective timed operation, by mechanism to be described below, (see heading Die Selector System).

Die Positioning System

In order to control the swinging of die support body (42) relative to its main rotor (26) and thus position the dies to adopt accurate matching positions as between the upper and lower rotary assemblies (12) and (14), pairs of inner and outer cam guide surfaces (100) and (102), FIGS. 6, and 22 to 26, are provided, mounted on both ones of respective mounting plates (16), and similar pairs of inner and outer cam guide surfaces (100) and (102) are provided on the other of the mounting plates (18). Inner cam guide surface (100) is formed in a guide plate (104) mounted on each mounting plate (16). Outer cam guide surface (102) is formed on a guide plate (106) also mounted on each mounting plate (16).

Similar inner and outer cam guide surfaces are provided by similar inner and outer guide plates mounted on each mounting plate (18).

The respective inner and outer guide cam surfaces in each pair are offset axially relative to one another, with the inner cam guide surfaces (100) being located inwardly, closer to main rotor (26) or (28) and with the outer cam guide surfaces (102) being located outwardly, slightly further from main rotor (26) or (28).

Figure 26:
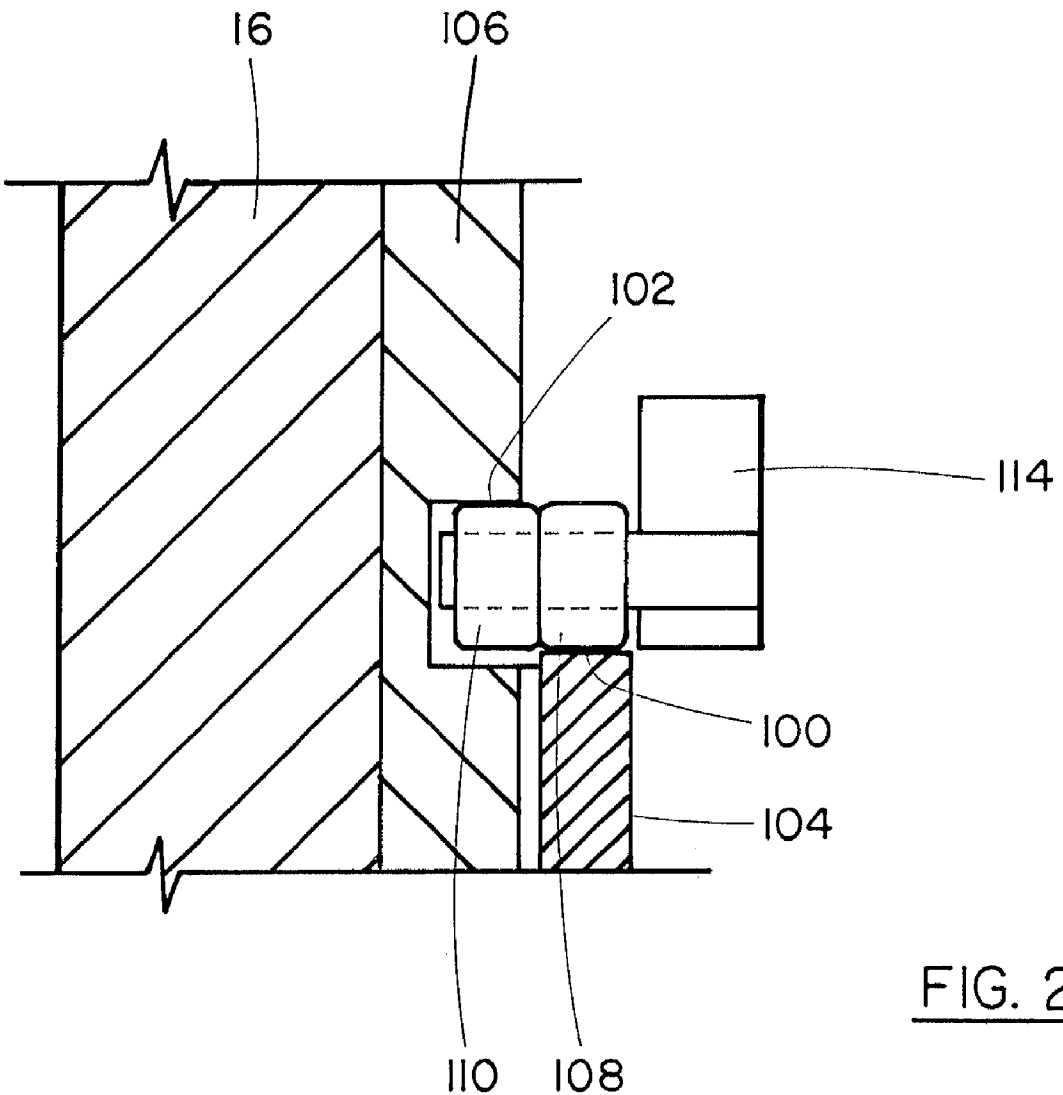
FIG. 26 is a section along line 26—26 of FIG. 23, greatly enlarged, showing the engagement of the guide rollers with their respective guide surfaces.
Figure 27:
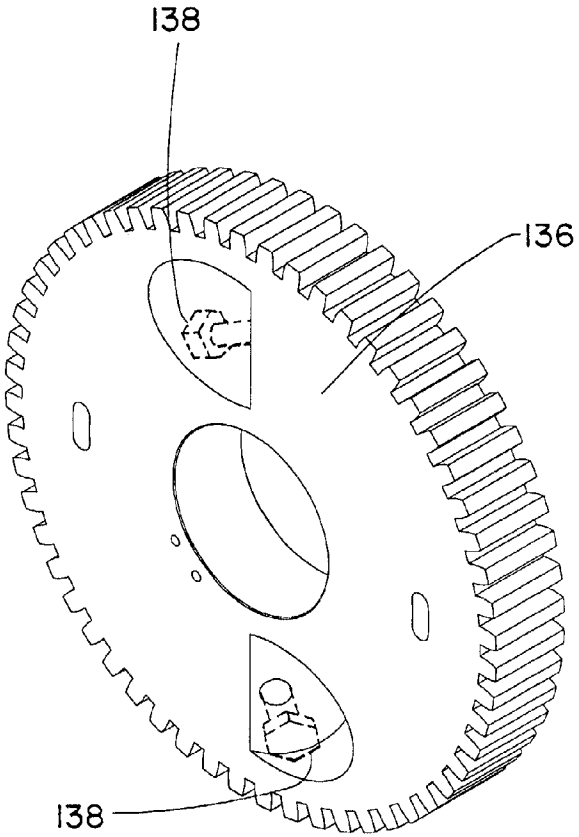
FIG. 27 is a perspective of one of the gear disks of the anti-backlash system.
Figure 29:
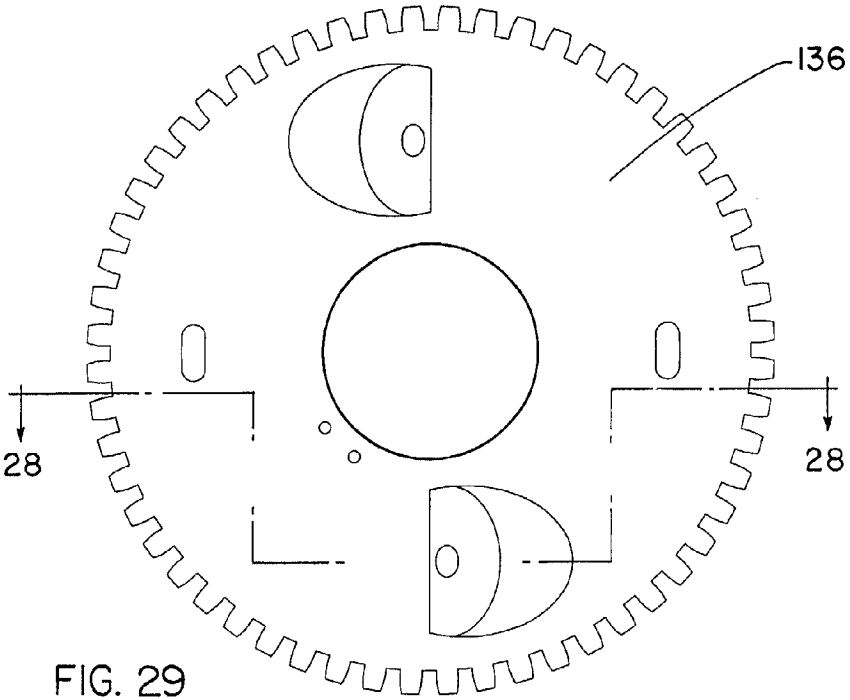
FIG. 29 is a front elevation of FIG. 27.
Figure 28:
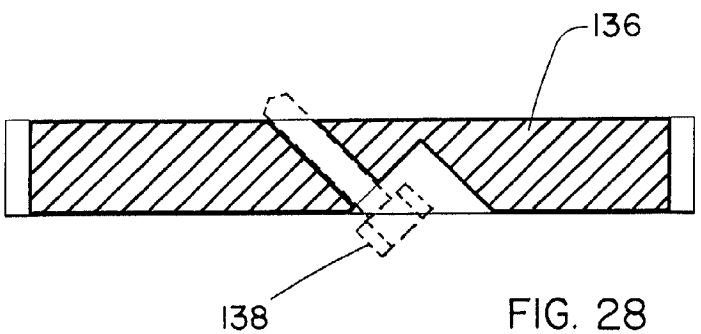
FIG. 28 is a section along line 28—28 of FIG. 27
Figure 30:
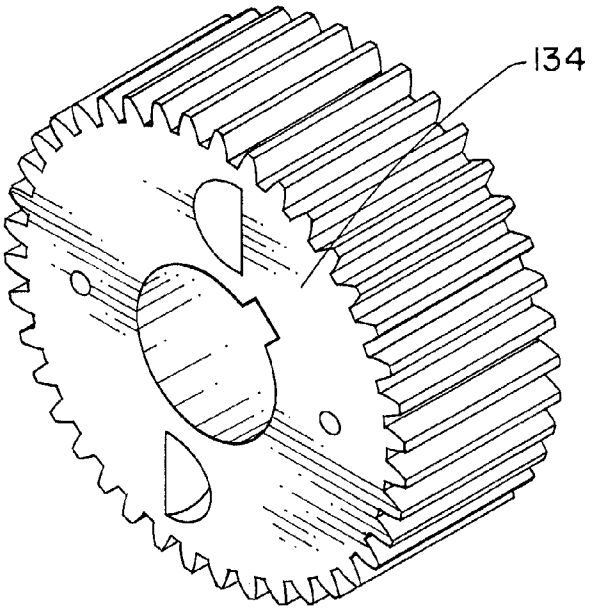
FIG. 30 is a perspective of the other of the gear disks of the anti-backlash system.
Figure 31:
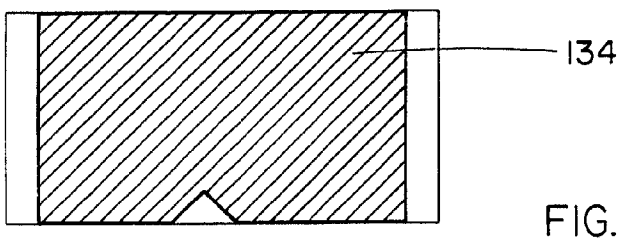
FIG. 31 is a section along line 31—31 of FIG. 30.
Figure 32:
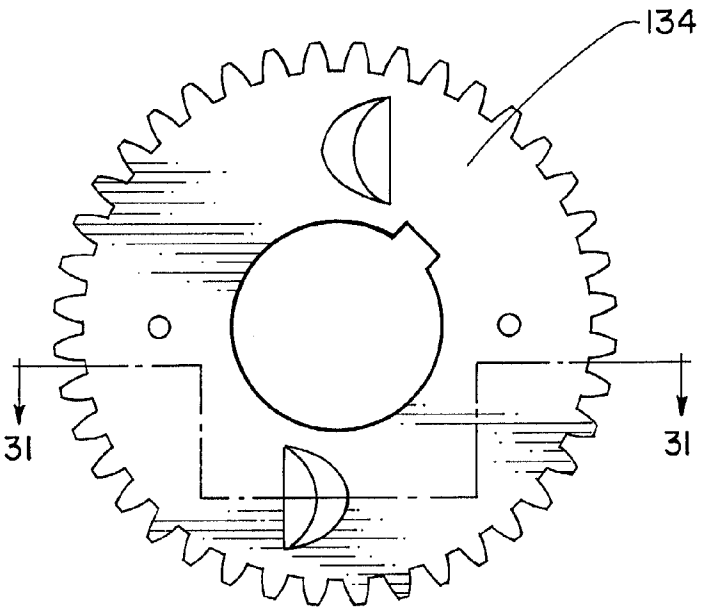
FIG. 32 is a front elevation of FIG. 31.

It will also be noted, FIG. 26, that the inner and outer cam guide surfaces are not co-planar with one another. Outer cam guide surfaces (102) are located around an arc which is slightly offset relative to inner cam guide surfaces (100), for reasons described below.

In order to control the orientation of the die support body (42) by means of the inner and outer cam guide surfaces (100), (102), inner and outer cam rollers (108) and (110) are provided. Cam rollers (108) and (110) are themselves mounted on mounting arms (112). Arms (112) are secured to blocks (114). Blocks (114) are in turn bolted to the stub shafts (116) and (118) at opposite ends of the die support body (42). Thus when the main rotors rotate, and the inner and outer cam guide rollers (108) and (110) follow their respective inner and outer cam guide surfaces (100) and (102), as described below, the mounting arms (112) will swing and thus cause rotation of the respective stub shafts (116) and (118) to which they are attached. This will cause swinging movement of the die support body (42). Swinging of the die support bodies (42), on respective upper and lower main rotors (26) and (28) ensures that the dies (50) carried on their respective die mounting blocks (44) will be held parallel with one another during that part of the rotary cycle when they close and open and perform their operations on the web piece, and thus remain parallel to the work piece throughout the critical time from just before contact with the work piece to just after separation from the work piece.

The inner cam rollers (108) are located so as to contact and follow their respective inner cam guide surfaces (100).

The outer cam rollers (110) are located, outwardly with respect to the inner cam rollers (108) so as to contact and follow their respective outer cam guide surfaces (102).

The inner and outer cam rollers (108) and (110) roll on a common axis. However because of the offset of the outer cam guide surfaces (102) relative to the inner cam guide surfaces (100) (FIG. 26), the inner cam rollers will roll in one direction, whereas the outer cam rollers will roll in the opposite direction, one rolling clockwise and the other rolling anti-clockwise. This enables to the cam rollers to roll in close contact with their respective guide surfaces, without rubbing friction.

The inner and outer guide rollers always roll on their respective guide surfaces and are never in rubbing contact with any other surface. This is a major advantage over certain older proposals where rollers or guide pins ran in closely fitting grooves and caused continuous rubbing friction. This in turn resulted in wear of the guide surfaces, and the rollers or pins became loose in their grooves and thus caused loss of precision in the matching of the positions of the dies.

Die Selector System

Figure 25:
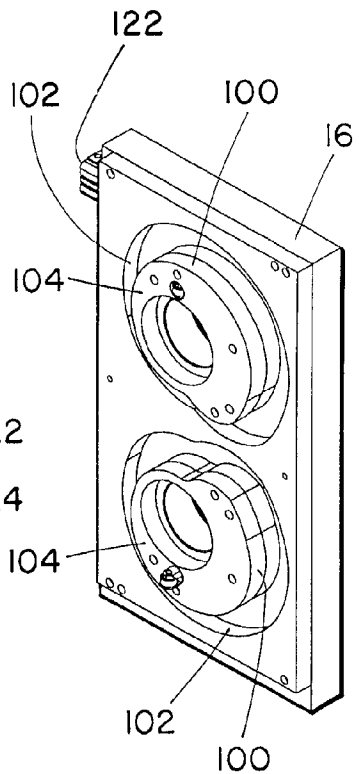
FIG. 25 is perspective of FIG. 23 from the opposite side from FIG. 24.
Figure 24:
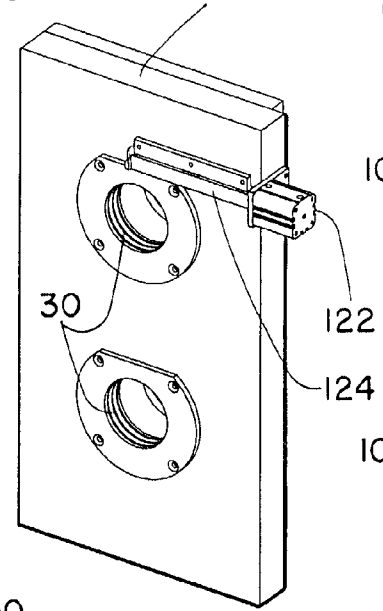
FIG. 24 is a perspective of FIG. 23.
Figure 23:
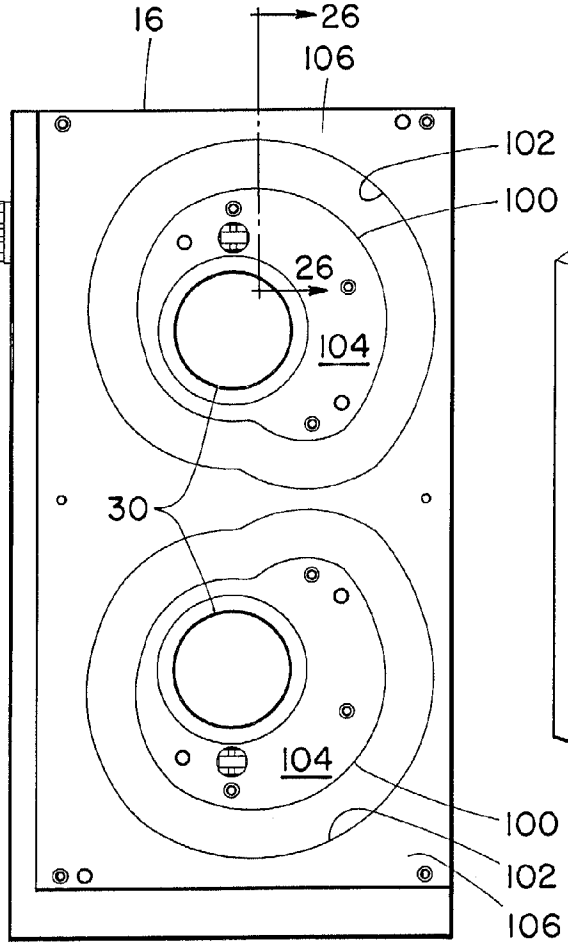
FIG. 23 is a front elevation of FIG. 22.
Figure 22:
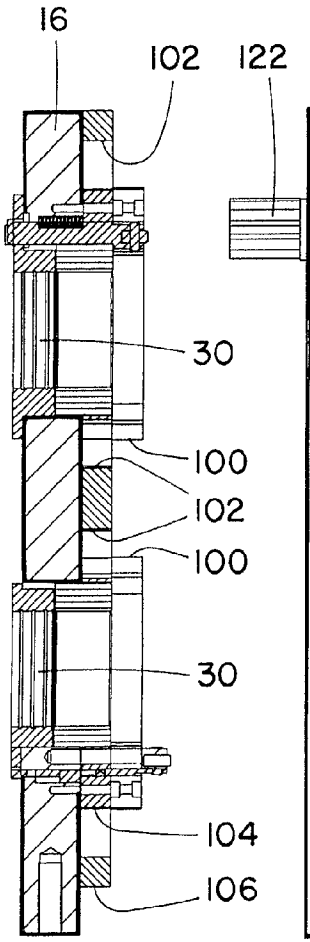
FIG. 22 is a sectional elevation of a mounting plate showing the selective die operating system and guide plates.

In order to select the time of or duration of skipping of an operation by the moveable die portion, by operation of the cam drive body (86) by means of the cam control rods (92) and (94), the invention provides an extension or enabling power cylinder (120), FIGS. 22, 24 and 25, and a retraction or disabling power cylinder (122) Mounted on mounting plates (16) and (18) on opposite sides of respective upper and lower rotary assemblies. Each cylinder (120) and (122) is connected to a slide bar (124). Slide bar (124) is extendable and retractable axially parallel to the axis of the respective main rotor (26) or (28). The free end of each slide bar (124) has an angled control surface (126). Surface (126) is positioned so that, when in the extended position it will engage the free end of the adjacent cam control rod (92) or (94), when the main rotors rotate. This will drive the respective control rod axially inwards into its die bearing body recess (76). Thus operation of enabling cylinder (120) will cause extension of the moveable die portion (74) into its enabled or operative position. Operation of the disabling cylinder (122) on the opposite side of the rotary assembly will cause disabling or retraction of the moveable die portion (74). Each cylinder moves only momentarily so that once its adjacent cam control rod (92) or (94) has been contacted and moved axially, the cylinder is discharged and the control surface (126) is withdrawn.

When the cam drive body (86) is thus moved to disable or retract the moveable die portion (74), the teeth (88) on the cam drive body (86) will interlock with the teeth on the cam plate (80) of moveable die portion (74), see FIG. 6. This interlocking will secure the moveable die portion (74) in its disabled or retracted position, and at the same time secure the cam drive body (88) against inadvertent movement.

However when the cam drive body (86) is moved to enable or extend the moveable die portion (74) into its operative or enabled position, the teeth (88) and (82) will be extended out of interlocking engagement. In this position the teeth (88) and (82) will contact each other only on their tips, in the position shown in FIGS. 3 and 5. Such contact will normally be maintained secure, and the cam drive body (86) will be held in position by such contact, as a result of the compression of springs (66).

However in order to avoid any tendency for the cam drive body (86) to slide sideways, during high speed operation of the apparatus, for example, it may be desirable to provide some form of indexing or interlock to hold the cam drive body (86) against inadvertent sliding movement. Such indexing can be provided in the form of an indexing plunger (128). Plunger (128) is mounted in a suitable recess in the die support body and is operated by a spring, in known manner. Cam drive body (86) is provided with an interlock recess (130). Plunger (128) will seat in recess (130), thus locking the cam drive body (86) in the extended, enabled position. In the disabled position plunger (128) will be inoperative. Two such plungers and recesses can be provided for added security, where it is necessary to secure the body (86) in both positions.

Main Rotor Drive System.

In order to drive the upper and lower rotary assemblies, selectively controllable drive motors, and gear boxes (20), see FIG. 1, are provided for each pair of assemblies. By suitable start/stop and speed controls, it is possible to control, speed up or slow down and start and stop each motor (20), on each pair of rotary assemblies. This makes it possible to vary the location and spacing of the formations in the work piece (w), with a minimum of alteration in the production line. Such controls are known in the art and require no description. The drive motor (20) will drive one of the upper and lower rotary assemblies. In this case it is shown driving the lower rotary assembly. The other rotary assembly will be coupled to the driven rotary assembly by a drive gear train comprising gears (22) and (24) (FIG. 3). In order to ensure that there is zero backlash between the two gears (22) and (24) a backlash elimination connection (132) is provided, FIGS. 3 and 29 to 32. This anti-backlash connection (132) comprises gear (24) having a two separate tooth disks (134) and (136). The first tooth disc (134) is keyed to its shaft, and is fixed. The second tooth disk (136) is rotatable on the same shaft. The second disk (136) is connected to the first disc by angled adjustment bolts (138). Bolts (138) are threaded in the second disk (136) and extend diagonally through suitable angled bores into contact with suitable angled bearing surfaces, on first tooth disk (134). By adjusting bolts (138) the second disk (136) can be rotated slightly relative to first disk (134). This will cause the gear teeth on first and second disks (134) and (136) to move slightly out of alignment with one another. Thus it is possible, by careful adjustment of bolts (138) to take out all the backlash in the gear system.

This will ensure that the upper and lower rotary assemblies operate in precisely matched relation and will ensure accurate registration of the respective dies on the upper and lower rotary assemblies.

It will of course be appreciated that the invention is also applicable to the use of two or more die support bodies and two or more respective dies on each main rotor.

Figure 33:
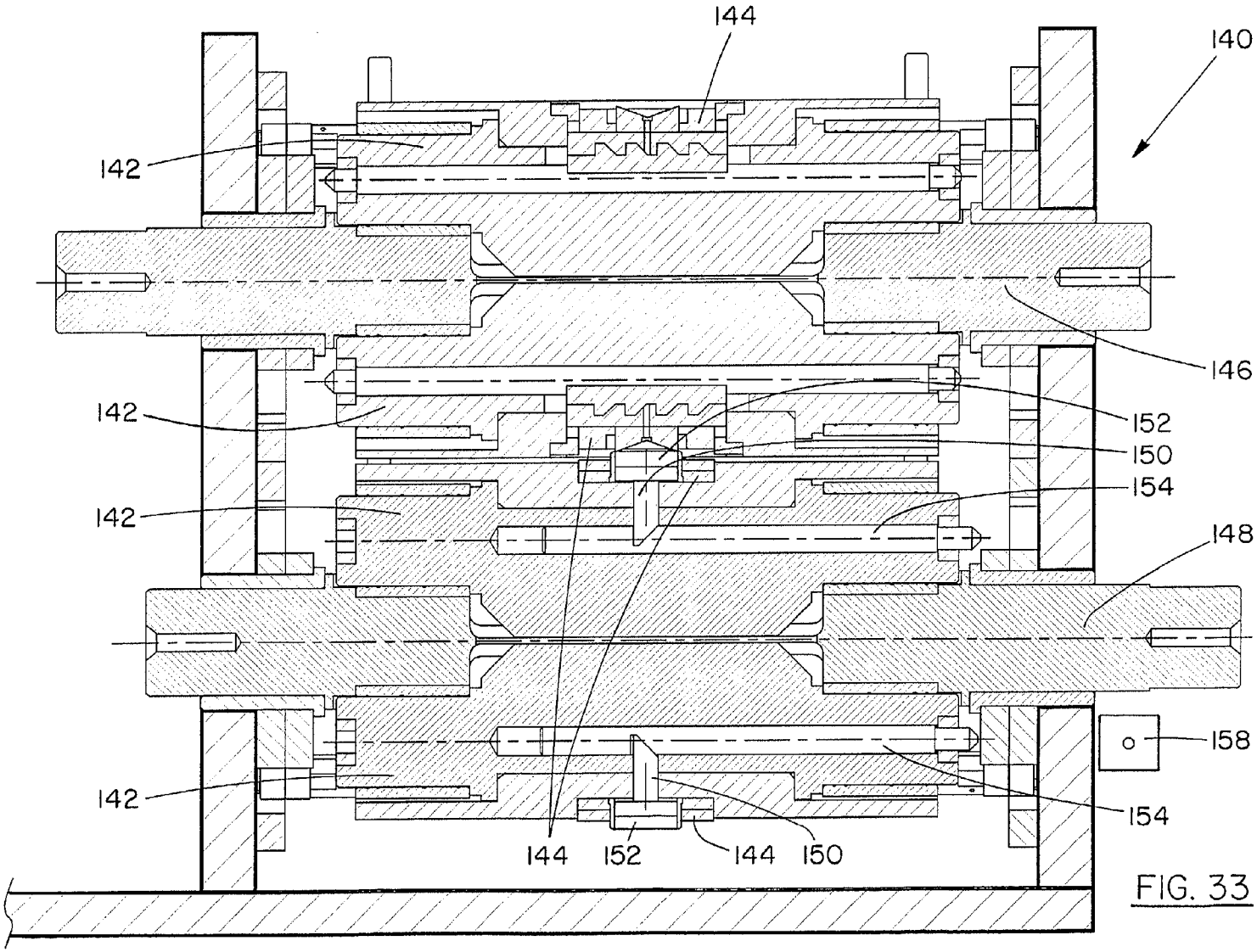
FIG. 33 is a sectional view of an alternate embodiment showing two die support bodies and two dies on each main rotor.

A typical apparatus (140) having two die support bodies (142) and two dies (144) on each main rotor (146), (148), is shown in FIG. 33. The details of the cams and cam guides are omitted for the sake of clarity. However they will be similar to those shown on the FIG. 1 to 30 embodiment. Similarly, the moveable dies and die movement devices are not shown but will be similar to those shown in the FIG. 1 to 30 embodiment.

A further typical apparatus (not shown), may have four die support bodies and four dies all mounted on single main rotors and. The details would be essentially the same as for the two die embodiment, but with the greater number of components.

There may also be movable dies on both upper and lower main rotors, the details of which will be similar to those described above.

Slug Ejection

Figure 10:
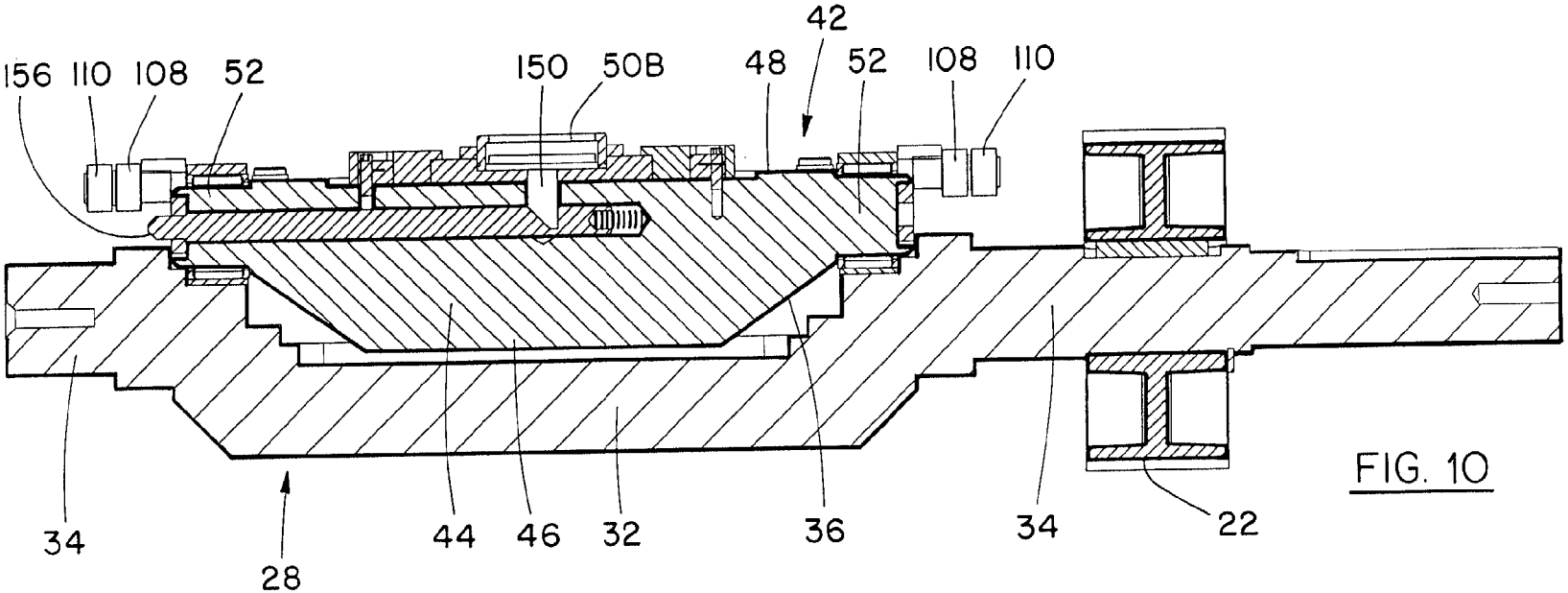
FIG. 10 is a side elevation of a lower main rotor and drive gear.
Figure 11:
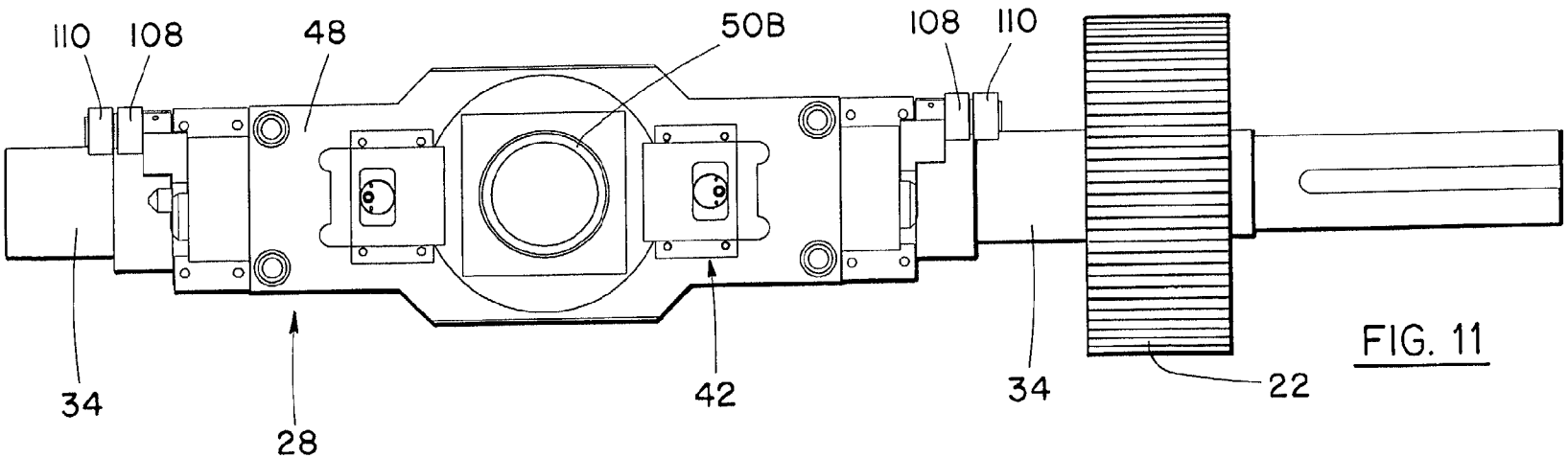
FIG. 11 is a bottom plan view of FIG. 10.
Figures 12, 13, 14, 15:
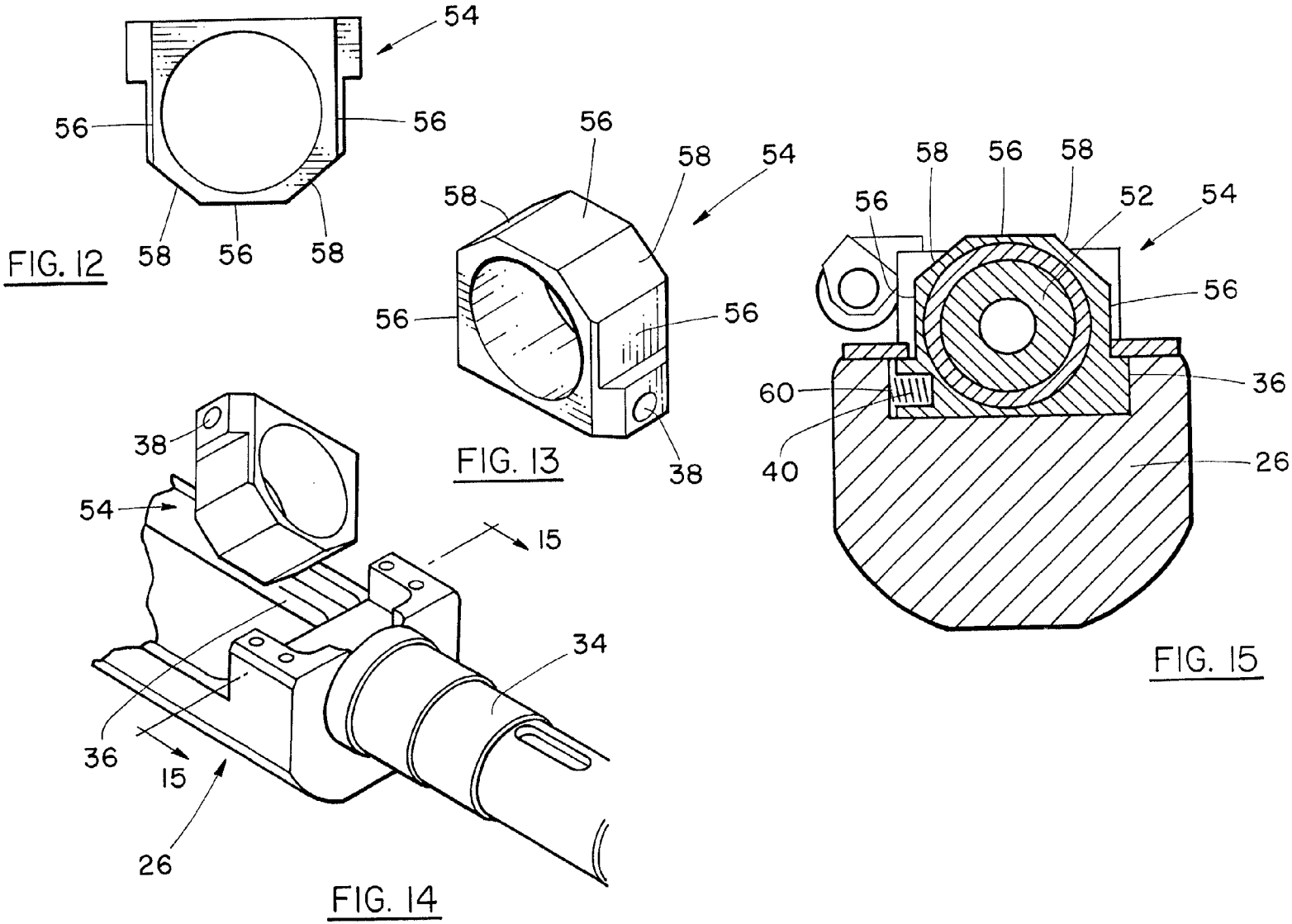
FIG. 12 is a side elevation of a bearing body.
FIG. 13 is a perspective view of a bearing body.
FIG. 14 is an exploded view showing the bearing body and a portion of a die support body and recess.
FIG. 15 is a section along line 15—15 of FIG. 14.
Figure 16:
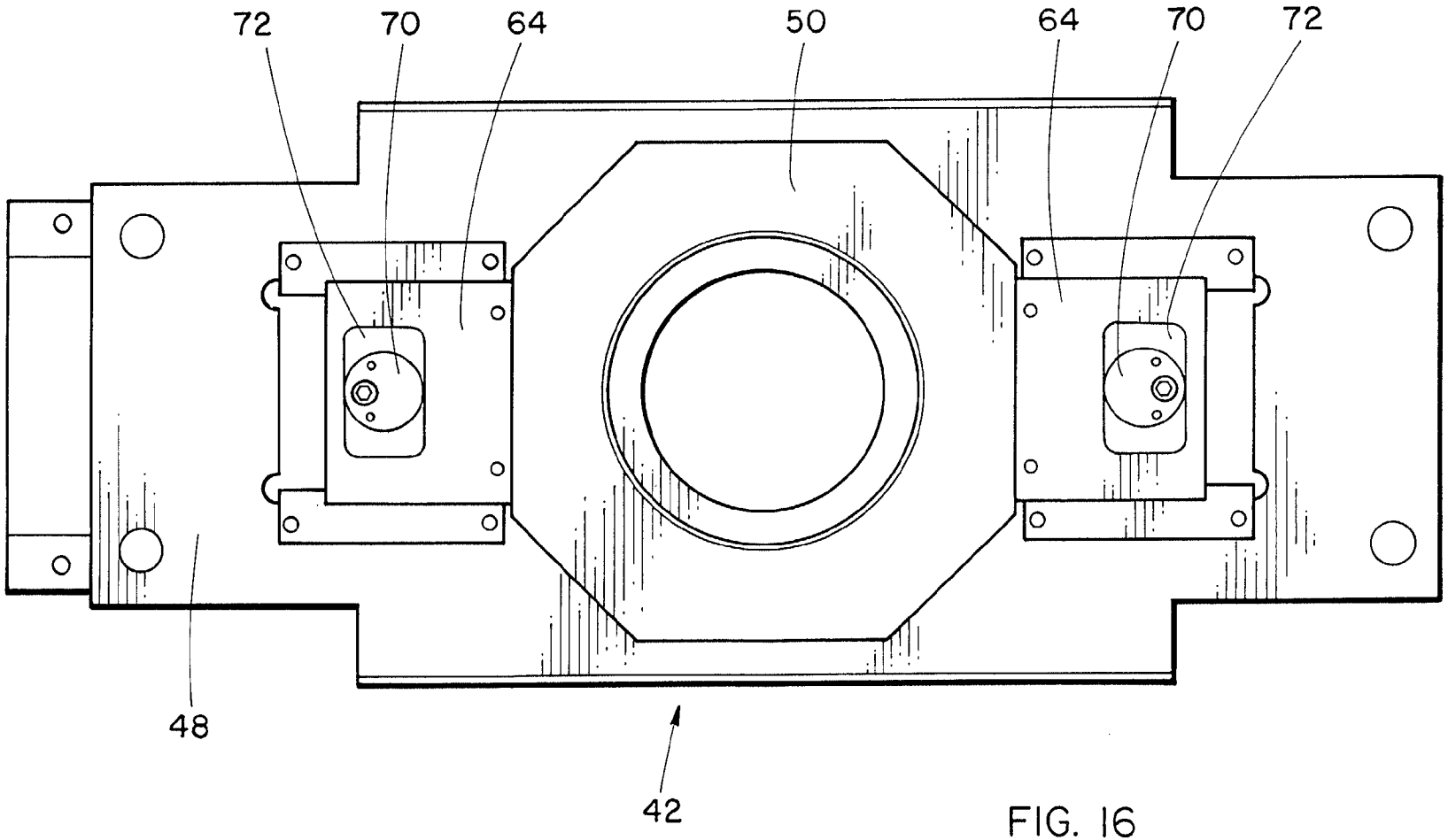
FIG. 16 is a bottom plan view of a die support body showing the quick release die mounting system.
Figure 17:
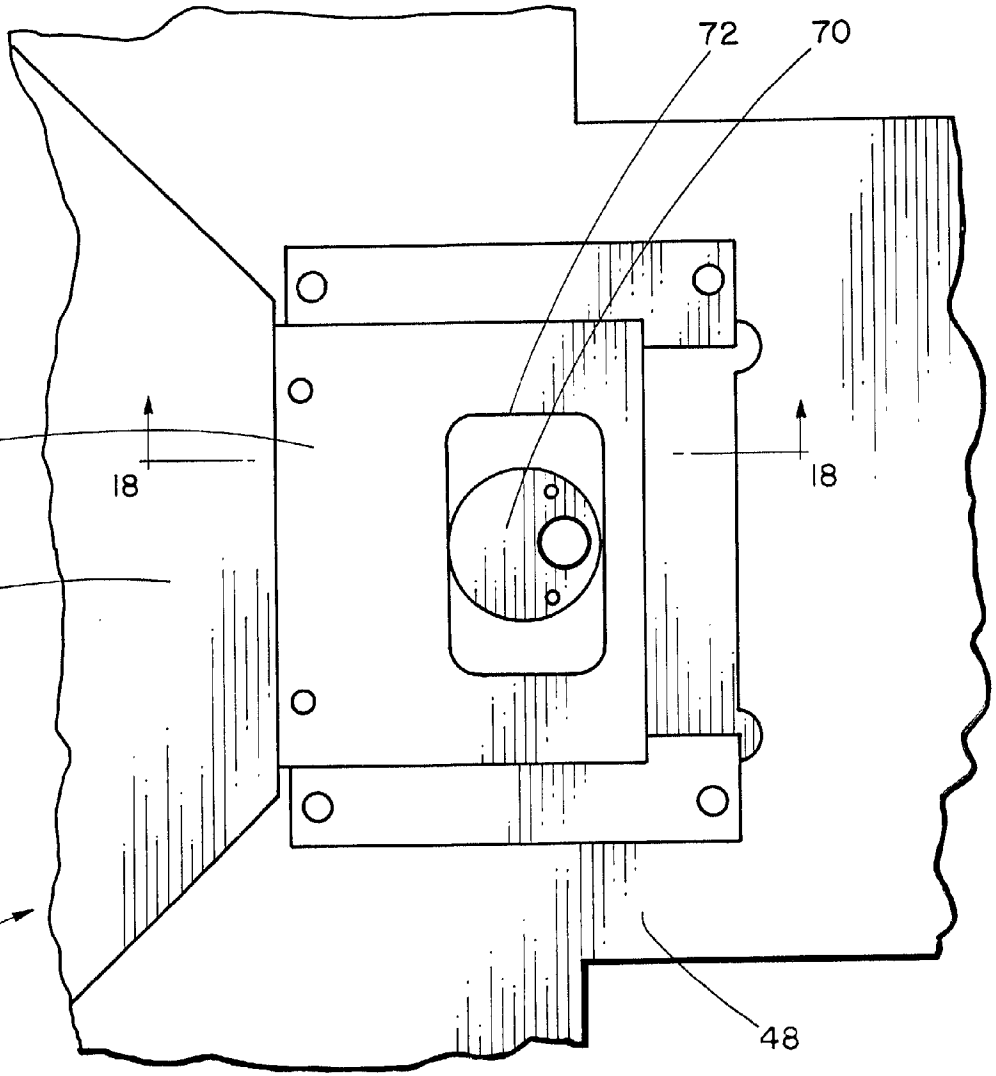
FIG. 17 is an enlarged bottom plan of the quick release die mounting system.
Figure 19:
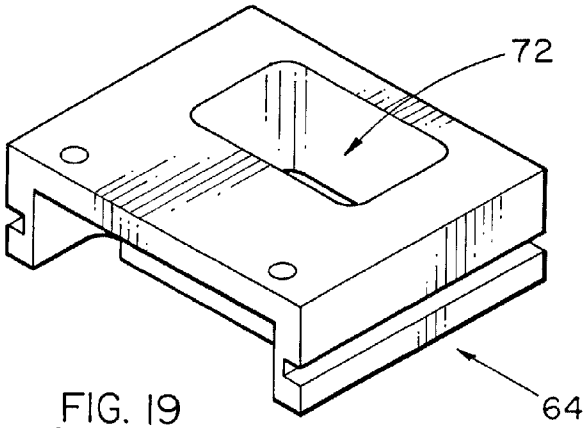
FIG. 19 is a perspective view of the slide clamp for the quick release die mounting system.
Figure 21:
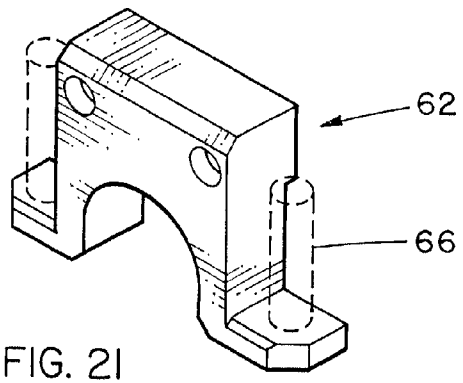
FIG. 21 is a perspective of a die side edge bracket of the quick release die mounting system.
Figure 18:
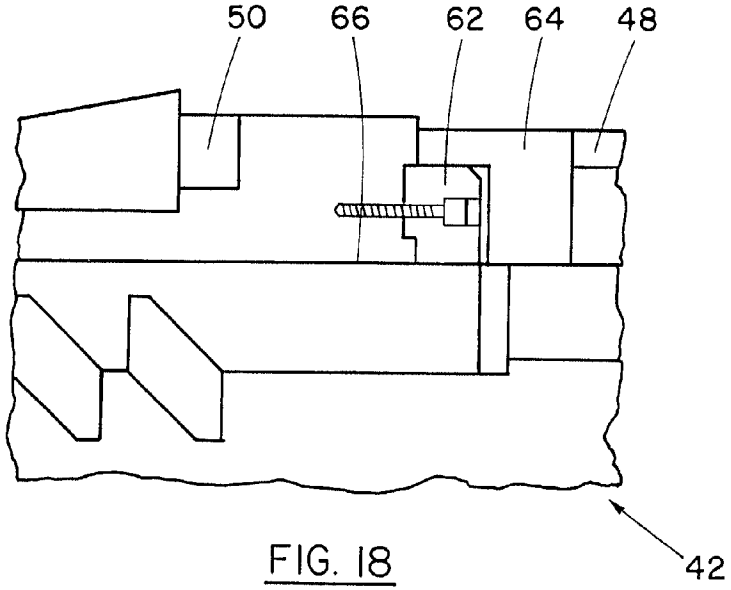
FIG. 18 is a section along line 18—18 of FIG. 17.
Figure 20:
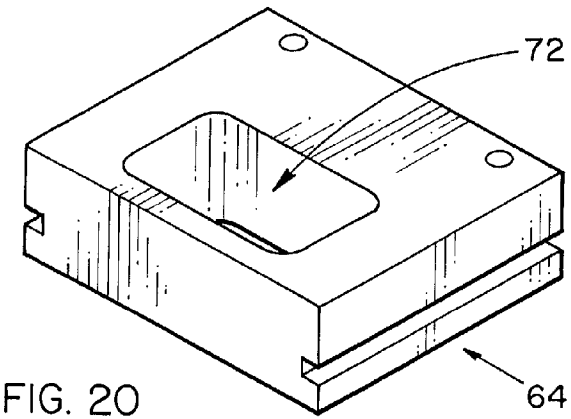
FIG. 20 is a perspective of FIG. 19 from anothe angle.

In the case of the female die in a die set, these dies will usually be receiving the slug or blank of sheet metal removed by the male die. To provide for positive slug ejection from the female dies, ejector pins (150), FIGS. 10 and 11, are provided in the die support body (42), which are slidable transversely to the axis of rotation, into and withdrawn from the female die (50B). Pins (150) are connected to an operating plate (152) within the die support body (42). Plate (152) is moveable, under the control of ejector shaft (154). Ejector shaft (154) extends out to one side of the die support body (42). The free end of the ejector shaft (154) is adapted to be contacted and moved by means of a movable control slide (156). Slide (156) is in turn selectively operated by a cylinder (158) similar to the cylinders (120) on the upper main rotor (26). Timing of the operation of cylinder (158) will cause the slug to be ejected while the female die (50B) is facing downwardly, so that the slug falls freely under gravity.

It will also be understood that while the rotary apparatus has been described in association with dies (50), other forms of dies may be used with advantage in the machine according to the invention.

Thus the dies can be replaced with any form of tool which can be operated at high speed on a moving work piece. Even simple shear blades could be used if desired for high speed shearing a moving work piece Method of Operation The method of operation of the apparatus is believed to be self-evident from the foregoing description.

By simply rotating both the main rotors in unison, in opposite directions, one clockwise and the other anti-clockwise, the die support bodies will be swung into orientations which are parallel to but spaced from the work piece. Continued rotation of the main rotors will cause the dies to close on the work piece and thus perform an operation.

As the main rotors continue to rotate, the dies will separate from the work piece, while remaining parallel thereto.

As the main rotors continue their rotation, the cams and guides will control the orientation of the die support bodies relative to their main rotors, and will once again bring them into parallel spaced apart relation just before their dies contact the work piece again.

When it is desired to vary the spacing between formations caused by the die operations, the motor is slowed down, or speeded up at a predetermined point in its rotation. The work piece will continue its movement at its preset speed. The dies now contact the work piece, either at greater spacings, or at closer spacings. The motor can then be reset to its original speed once again, after a suitable timed interval, and the die operations will then continue at the same intervals as before.

Similarly when it desired to skip a die operation, one of the cylinders (120) and (122) can be operated so as to move the control rods (92) and (94) and thus cause the moveable die portion (74) to be retracted into its disabled position in the die support body. This may happen for only one revolution of the main rotors in many cases. On the next revolution, or whenever it is desired, the controls rods (92) and (94) can be moved in the opposite direction, thereby extending the moveable die portion (74) into the operational, enabled position, and operations on the work piece will then resume as before.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A rotary apparatus having a first rotating die assembly and a second rotating die assembly arranged in juxtaposition with one another on respective first and second sides of a strip work piece movement path, and operable in unison together to perform operations on said work piece passing therebetween, each said die assembly comprising;

a main rotor mounted for rotation;

at least one die support body supported by said main rotor, and being swingable relative to said main rotor;

control cams connected to said at least one die support body;

cam guides mounted adjacent to said main rotor and engageable by said control cams;

die support body bearings mounted on said main rotor for carrying said die support body; and, moveable mountings for said die support body bearings permitting movement of said die support body bearings relative to said main rotor, whereby to permit said dies to move slower at the time of contact with the work piece and then to move faster during contact with said work piece and then to slow down again as they separate from said work piece.

2. A rotary apparatus as claimed in claim 1 and wherein the moveable mountings are spring biased in a retrograde position relative to the direction of rotation of said main die rotors, and are moveable against such biasing to permit temporary advancing movement of said bearings.

3. A rotary apparatus as claimed in claim 1 wherein the die support body bearings comprise bearing bodies having a predetermined bearing body width dimension, and including bearing recesses formed in said main rotors for receiving said bearing bodies, said bearing recesses defining a bearing recess width greater than said bearing body width, whereby said bearing bodies are moveable within said bearing recesses.

4. A rotary apparatus as claimed in claim 3 including springs located in said bearing recesses and engaging respective said bearing bodies, and biasing them in a retrograde direction.

5. A rotary apparatus as claimed in claim 1 including a moveable die mounted on a said die support body, said die being moveable radially outwardly and inwardly relative to said die support body.

6. A rotary apparatus as claimed in claim 5 and including a die movement control operable to cause said moveable die to move as aforesaid.

7. A rotary apparatus as claimed in claim 6 wherein the die movement control includes a control rod moveable relative to the moveable die, and a rod movement device for moving the rod as the main rotator rotates.

8. A rotary apparatus as claimed in claim 7 having a rod movement device control operable to enable and to disable said rod movement device whereby to selectively enable or disable said moveable die for selective timing of an operation on said work piece.

9. A rotary apparatus as claimed in claim 1 including a plurality of said die support bodies on said main rotor and respective dies carried by said die support bodies whereby to perform a plurality of said operations on said work piece for each revolution of said main rotor.

10. A rotary apparatus as claimed in claim 1 wherein each pair of said main rotors is operated by an individual electric motor, and having on/off controls and speed controls for each said electric motor, whereby each said pair of main rotors may be operated, or stopped, at timings and speeds varying from any adjacent apparatus performing operations on said work piece.

11. A method of performing rotary operations on a moving work piece by rotating a pair of main rotors on opposite sides of said work piece, said main rotors carrying moveable die support bodies swingable relative to said main rotors, said die support bodies in turn carrying respective dies for performing operations on said work piece, comprising the steps of;

continuously rotating said main rotors;

swinging said die support bodies into orientations parallel to but spaced from said work piece, during said rotation of said main rotors;

closing and opening said die support bodies on said work piece as said main rotors continue to rotate while remaining parallel to said work piece; controlling swinging of said die support bodies by control cams;

moving at least one moveable die relative to its die support body between enabled and disabled positions to procure selective operation on said work piece on some revolutions of said main rotors and to prevent operation on said work piece on another revolution of said main rotors.

12. The method of performing rotary operations on a moving work piece as claimed in claim 11 and including operating a slug ejector on one said die, in timed relation to rotation of said main rotors, to eject a slug of metal therefrom.

13. The method of performing rotary operations on a moving piece as claimed in claim 11 and including the steps of gulding said dies on said main rotors into parallel spaced apart positions just prior to said dies making contract with a work piece, and continuing such guiding to maintain said dies parallel as they continue and complete their operation of said work piece.

14. The method of performing rotary operations on a moving work piece as claimed in claim 11, and including adjusting said main rotors relative to one another by anti-backlash gear devices whereby to ensure a precise relationship between said main rotors.

* * * * *